US006508220B1

(12) United States Patent
Akaike et al.

(10) Patent No.: US 6,508,220 B1
(45) Date of Patent: Jan. 21, 2003

(54) STARTER

(75) Inventors: Junichi Akaike, Tokyo (JP); Masaki Sugaya, Tokyo (JP); Michiyasu Kuwano, Tokyo (JP); Fumihiko Aiyama, Tokyo (JP); Hiroji Kawasaki, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/639,561

(22) Filed: Aug. 16, 2000

(30) Foreign Application Priority Data

| | | |
|---|---|---|
| Aug. 25, 1999 | (JP) | 11-238641 |
| Aug. 25, 1999 | (JP) | 11-238642 |
| Dec. 7, 1999 | (JP) | 11-347866 |

(51) Int. Cl.[7] ..... F02N 3/02; F02N 5/02

(52) U.S. Cl. ..... 123/185.14; 123/185.3; 185/41 A

(58) Field of Search ..... 123/185.14, 185.2, 123/185.3, 185.4; 185/39, 40 R, 41 R, 41 A, 41 C

(56) References Cited

U.S. PATENT DOCUMENTS

| | | | | |
|---|---|---|---|---|
| 3,010,443 A | | 11/1961 | Lyvers | 123/179 |
| 3,164,142 A | * | 1/1965 | Anderson et al. | 123/185.14 |
| 3,306,277 A | | 2/1967 | Gudmundsen | 123/185.14 |
| 3,861,374 A | * | 1/1975 | Dooley et al. | 123/185.14 |
| 4,850,233 A | | 7/1989 | Ishigo | 74/6 |
| 5,287,832 A | | 2/1994 | Uhl | 123/185.3 |
| 5,537,966 A | * | 7/1996 | Ohnishi | 123/185.14 |

FOREIGN PATENT DOCUMENTS

| | | |
|---|---|---|
| JP | 5223025 | 6/1977 |
| JP | 1091075 | 6/1989 |
| JP | 63188 | 1/1994 |
| JP | 717810 | 4/1995 |
| JP | 724614 | 6/1995 |
| JP | 724615 | 6/1995 |
| JP | 2013171 | 1/1999 |

* cited by examiner

*Primary Examiner*—Andrew M. Dolinar
(74) *Attorney, Agent, or Firm*—Baker Botts L.L.P.

(57) ABSTRACT

A starter that is capable of minimizing fluctuations in the pulling force of a starter rope so as to make it possible to perform a smooth pulling operation when starting an internal combustion engine includes a driving section (A), a driven section (B), and a buffering/power-accumulating device (15) interposed between the driving section (A) and the driven section (B).

10 Claims, 8 Drawing Sheets

STARTER

BACKGROUND OF THE INVENTION

The present invention relates to a starter for an internal combustion engine and, in particular, to a starter wherein fluctuations in the force required to pull the starter rope can be minimized, thereby enabling the starter rope to be smoothly pulled and providing excellent performance of the starter. Specifically, the present invention relates to a power-accumulation type starter wherein the rotational force of the starter is accumulated by means of a spiral spring for starting an internal combustion engine.

In some conventional manual starters for an internal combustion engine, the starting of the internal combustion engine is performed through a process wherein the starter rope is pulled to rotate the rope pulley, and the rotation of the rope pulley is directly transmitted to the crank shaft of the engine so as to start the engine. There is also known a starter wherein a decompressor is employed with a view to minimizing the force for pulling a starter rope handle.

There is also known, as another type of conventional starter for internal combustion engines, a power-accumulation type starter wherein a spiral spring is manually wound up so as to accumulate the rotational force, and the power thus accumulated is then released all at once. According to the conventional starter, a pulley is rotated by pulling a starter rope by means of the starter rope handle, and the rotational force of the pulley is accumulated in the spiral spring, the rotational force being subsequently transmitted to the crank shaft of the internal combustion engine through an actuating pulley so as to start the engine.

The conventional starter constructed as described above is, however, accompanied with a problem in that the starter rope handle for pulling the starter rope is required to be pulled at a relatively high speed and for a long distance, so that it is difficult for a person having weak physical strength to easily start the engine. Moreover, since the rope handle-pulling operation is accompanied with a large fluctuation in the pulling force due to the load to be imposed by the internal combustion engine side in accordance with the rotation of the crank shaft, it is difficult to perform a smooth pulling operation. Hence, it is difficult for a person having weak physical strength to easily start the engine. When a decompressor is employed for the purpose of alleviating the pulling force, an unburned air-fuel mixture is allowed to be released to the external atmosphere, thus causing environmental problems.

On the other hand, a starter having a mechanism wherein the actuating pulley is arranged to be automatically rotated as the rotational force is accumulated up to a predetermined degree is accompanied with problems that the structure thereof becomes complicated, thus making the starter larger in size and weight, and hence unsuitable for use in a small working machine.

BRIEF SUMMARY OF THE INVENTION

The present invention has been made to solve the aforementioned problems. Therefore, it is an object of the present invention to provide a starter which is capable of minimizing fluctuations in the pulling force of the rope handle so as to make it possible to perform a smooth pulling operation and so that the starter can be easily manipulated even by a person having weak physical strength in starting the engine. Another object of the present invention to provide a starter which is excellent in its performance in starting an internal combustion engine and free from environmental problems.

A further object of the present invention is to provide a power-accumulation type starter which, in contrast to the conventional recoiling rope type starter, is capable of easily and reliably starting the engine, irrespective of the pulling speed as well as pulling distance of the starter rope by means of the rope handle, while allowing the starter to be employed in the same manner as the conventional recoil starter by canceling a power accumulation mechanism if the accumulation of rotational force is not required.

A further object of the present invention is to provide a power-accumulation type starter that is simple in construction and light in weight, thereby making it suited for use in a small working machine, that can be easily operated to start the engine while a machine equipped with an internal combustion engine having the starter of the present invention is carried on an operator's back by locating a rope handle and a start reset lever near the operator's hands. In addition, if accumulation of rotational force in a spring is not required to start the engine, the starter of the present invention can be used as a recoil type starter having a mechanism for buffering the load to be imposed thereon from the engine side.

With a view to attaining the aforementioned objects, there is provided, in accordance with the present invention, a starter comprising a driving section, a driven section, and a buffering/power-accumulating device interposed between the driving section and the driven section. The buffering/power-accumulating device is enabled, during the driving process of the driving section, to buffer a load from an engine side and to accumulate the power supplied by the driving of the driving section, and the driven section is arranged to be actuated by the accumulated power.

With the starter of the present invention having the aforementioned structure, since the buffering/power-accumulating device is interposed between the starter rope constituting the driving section and the crank shaft of the internal combustion engine constituting the driven section, all of the force for pulling the starter rope is not directly related to the starting of the engine, but part of the pulling force of the starter rope is accumulated in the spiral spring mechanism in an initial part of the process of recoiling, and the accumulated pulling force is afterward combined with the actual pulling force of the starter rope in a later part of the process of recoiling, thereby presenting a resultant force to start the engine. Therefore, even if the force for pulling the starter rope is weak, the engine can be reliably started. In particular, the buffering/power-accumulating device is capable of not only functioning to buffer and accumulate the pulling force of the starter rope but also providing an additional force for starting the engine by releasing the power accumulated therein.

In a preferred embodiment of the present invention, the driving section comprises a reel, and the driven section comprises an interlocking pulley provided with a transmission mechanism through which the interlocking pulley is linked to the driving section. The buffering/power-accumulating device may be constituted by a spiral spring mechanism in which a spiral spring is interposed between a spiral spring box disposed on the driving section side and an actuating pulley disposed on the driven section side. An input device is provided to unidirectionally rotate the spiral spring box. In a preferred embodiment of the present invention, the input device for unidirectionally rotating the spiral spring box includes a one-way clutch, and the transmission mechanism is a centrifugal clutch which is constituted by engaging projections and start-up claws pivotally supported by the interlocking pulley so as to engage with the engaging projections, thereby enabling the rotation of the reel to be transmitted through the spiral spring mechanism to the interlocking pulley linked with the crank shaft of the internal combustion engine.

According to the starter constructed as described above and representing one embodiment of the present invention, the reel is manually rotated by a starter rope wound onto a starter pulley, and the resultant rotational force is once transmitted to the spiral spring mechanism before it is utilized for the rotation of the actuating pulley, so that the fluctuating load due to the working strokes of the internal combustion engine can be absorbed by the spiral spring mechanism, thereby making it possible to smoothly pull the rope handle. Therefore, the internal combustion engine can be easily started by even a person who has weak physical strength. Further, since the crank shaft is rotated through the spiral spring mechanism, the internal combustion engine can be started always with an optimum timing in terms of starting conditions, and the performance of the starter can be improved. Also, since the spiral spring mechanism is enabled to unidirectionally rotate by making use of the one-way clutch, the starter can be reliably operated and also can be made small in size.

A power-accumulation type starter, according to some embodiments of the present invention, has a spiral spring power-accumulating mechanism, a manual reel for accumulating a rotational force in the spiral spring power-accumulating mechanism, a reset lever having a stopper for stopping the rotation of the output side of the spiral spring power-accumulating mechanism to thereby retain the rotational force accumulated until a predetermined torque is reached, and a transmitting mechanism for transmitting an accumulated rotational force to a crank shaft of an internal combustion engine when the stopper is released from stopping the rotation of the output side.

In a preferred embodiment of the power-accumulation type starter according to the present invention, the reset lever is movable between a stop position and a free position by means of an instantaneous switching mechanism, and the instantaneous switching mechanism is provided with a spring member which is interposed between an anchoring portion and the reset lever.

In a preferred embodiment of the power-accumulation type starter according to the present invention, the spiral spring power-accumulating mechanism is featured in that it is constituted by a spiral spring which is interposed between a spiral spring box disposed on the input side and an actuating pulley disposed on the output side, that a rope groove for winding a rope is formed on an outer periphery of the manual reel, and that the spiral spring power-accumulating mechanism and the manual reel are coaxially mounted, and the reset lever is enabled to be manually moved from the stop position to the free position.

With the power accumulation type starter of the present invention that is constructed as described above, the rotational force can be effectively accumulated in the spiral spring power-accumulating mechanism even if the speed with which the rope handle is pulled is slow and even if:the pulling distance is short. Further, since the rotational force is transmitted to the crank shaft so as to start the engine in a state where the torque of the rotational force becomes sufficiently high, the engine can be very easily started. Additionally, when the stopper is arranged to be instantaneously released from stopping the power-accumulating mechanism at the moment when the rotational force of the actuating pulley has reached a predetermined value of torque, the engine can be reliably started. Furthermore, since a decompressor for facilitating the starting operation is not required to be used, there will be no environmental problem resulting from the release of the unburned air-fuel mixture.

Since the instantaneous switching mechanism according to the present invention is provided with a spring member which is interposed between the fixed portion of the switching mechanism and the reset lever, the construction thereof can be simplified and the operation thereof can be reliably performed. Further, since the spiral spring power-accumulating mechanism and the manual reel are coaxially mounted, the construction of the instantaneous switching mechanism can be simplified and kept small in size. Further, the power-accumulation type starter can be used as an ordinary recoil starter without making use of the spiral spring power-accumulating mechanism. In this case, the spiral spring will function as a buffering member, thereby making it possible to alleviate an increased load resulting from the compression stroke of the internal combustion engine.

DETAILED DESCRIPTION OF THE INVENTION

Figure 1:
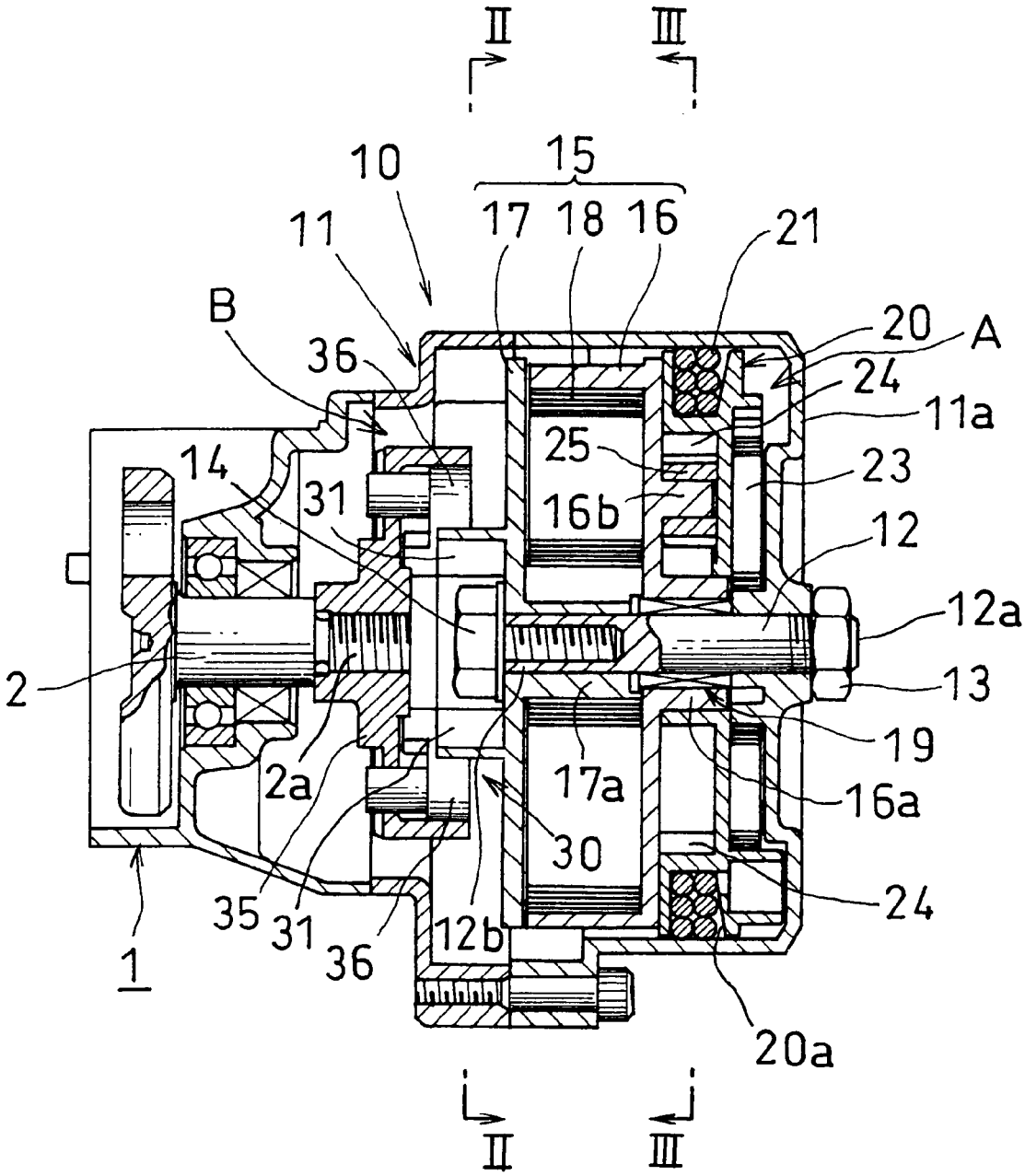
FIG. 1 is a cross-sectional view of a starter representing one embodiment of the present invention.

Next, one embodiment of a starter according to the present invention will be explained with reference to FIGS. 1 to 3 of the drawings. The starter 10 is located close to one end 2*a* of the crankshaft 2 of an internal combustion engine 1, such as a small air-cooled internal combustion engine. The starter 10 comprises a case 11, which is adapted to be mounted on one sidewall of the internal combustion engine 1. The case 11 is composed of two parts, one of which is a cup-like case member 11*a* to a central bottom portion of which one end 12*a* of a fixing shaft 12 is fastened by means of a nut 13. The starter 10 has a driving section A, a driven section B, and a spiral spring mechanism 15 functioning as a buffering/power-accumulating device and between a manual reel 20, constituting the driving section A, and an interlocking pulley 35, constituting the driven section B. Thus, the rotation of the manual reel 20 can be transmitted via the spiral spring mechanism 15 and the interlocking pulley 35 to the crankshaft 2 of the internal combustion engine 1.

The spiral spring mechanism 15 comprises a spiral spring 18 which is interposed between a spiral spring box 16, constituting an input side, and an actuating pulley 17, constituting an output side. The spiral spring box 16 and the actuating pulley 17 are disposed coaxially with each other and are rotatable relative to each other. Though not shown in detail in FIGS. 1 to 3, the outer end portion of the spiral spring 18 is attached in a well-known manner to the spiral spring box 16, while the inner end portion of the spiral spring 18 is attached, also in a well-known manner, to the actuating pulley 17, so that when either one of the spiral spring box 16 and the actuating pulley 17 is rotated relative to the other, the rotational force thereof is automatically supplied to the other.

The spiral spring box 16 of the spiral spring mechanism 15 is provided at the center thereof with a cylindrical portion 16*a*. A one-way clutch 19 is interposed between the inner peripheral wall of the cylindrical portion 16*a* and the outer peripheral wall of the fixing shaft 12, so that the spiral spring box 16 is supported by the fixing shaft 12 so as to be rotated unidirectionally about the fixing shaft 12. The actuating pulley 17 is provided at the center thereof with a cylindrical portion 17*a* which is received for rotation on the fixing shaft 12. A retaining bolt 14 is screwed into the fixing shaft 12 from the other end 12*b* of the fixing shaft 12 so as to support the actuating pulley 17 axially while allowing it to rotate about the fixing shaft 12.

The reel 20 is interposed between the cup-like case member 11*a* and the spiral spring box 16 and is rotatably supported on the outer periphery of the cylindrical portion 16*a* of the spiral spring box 16. The reel 20 is a rope pulley that can be manually rotated and has on its outer periphery an annular groove 20*a* so as to enable a rope 21 to be wound around it. In the same manner as in the case of the conventional recoiling rope type starter, one end of the rope 21 is fastened to a bottom portion of the groove 20*a*, while the other end of the rope 21 extends out of the cup-like case member 11*a* and is attached to a rope handle 22. Between the reel 20 and the cup-like case member 11*a*, there is interposed a recoil spiral spring 23, the outer end of which is attached to the rope reel 20 and the inner end of which is attached to a central portion of the cup-like case member 11*a*. The reel 20 is arranged to be rotated by pulling the rope 21 and then to be allowed to return to the original position on account of the restoring force of the recoil spiral spring 23, thereby enabling the rope 21 to be automatically wound up onto the reel 20.

Next, the interlocking mechanism between the rope reel 20 and the spiral spring box 16 will be explained with reference to FIGS. 1 and 3. Six engaging protrusions 24 are formed on the inner periphery of the rope pulley 20. A pivot pin 16*b* that protrudes toward the rope pulley 20 is integrally attached to the side wall of the spiral spring box 16 which faces the rope pulley 20, and an interlocking claw 25 is rotatably supported on the pivot pin 16*b*. The interlocking claw 25 is arranged to be elastically engaged with one of the engaging protrusions 24 by means of a pushing spring 26 urged toward the external direction. Therefore, when the rope pulley 20 is rotated in one direction R (the clockwise direction in FIG. 3), the spiral spring box 16 is also interlockingly rotated in the same direction R. On the other hand, when the rope pulley 20 is rotated in the opposite direction L (the counter-clockwise direction in FIG. 3), the interlocking claw 25 is pushed radially inwardly by the protrusions 24, thereby causing the interlocking claw 25 to pivot in the counter-clockwise direction about the pin 16*b*, thus to run idly.

The actuating pulley 17 is provided at the central portion thereof with a pair of engaging projections 31, which constitute one of the members of a transmission mechanism 30 disposed diametrically opposite each other relative to the axis of the crankshaft 2 of the internal combustion engine 1. The engaging projections 31 are joined to each other via an annular wall portion 32. On one side of the internal combustion engine 1 is disposed the interlocking pulley 35, which is fixed to the one end 2*a* of the crankshaft 2. Four start-up claws 36 constituting the other member of the transmission mechanism 30 are pivotally supported by the interlocking pulley 35. Each of these start-up claws 36 is ordinarily urged in the inward direction by means of a spring (not shown) and hence engaged with the engaging projections 31. However, when the internal combustion engine 1 is started, these start-up claws 36 are caused to pivot in the radially outward direction by centrifugal force so as to be disengaged from the engaging projections 31. That is, the start-up claws 36 are constructed to function as a centrifugal clutch.

As for the number of these start-up claws 36, although there is no particular limitation as long as there is at least one start-up 36 claw, four start-up claws 36 are included in this embodiment in view of suitably dispersing the shock generated at the moment of actuating the start-up claws 36 as well as in view of ensuring the actuation of the start-up claws 36.

Next, the operation of the starter constructed according to the invention will be explained. When the internal combustion engine 1 is to be started, the rope handle 22 is manually pulled so as to rotate the rope pulley 20. The rotation of the rope pulley 20 is transmitted to the spiral spring box 16 through the interlocking claw 25, which is resiliently engaged with one of the engaging protrusions 24 (see FIG. 3), thereby allowing the spiral spring box 16 to be rotated synchronously with the rotation of the rope pulley 20. When the pulling force of the rope handle 22 stops, the rope pulley 20 is allowed to reversibly rotate and return to the original position due to the accumulated power (restoring force) of the recoil spiral spring 23. As a result, the rope 21 is automatically wound up. However, the spiral spring box 16 is prevented from rotating reversibly due to the one-way clutch 19, thereby supplying the spiral spring 18 with a rotational force. Since the pulling force of the rope handle 22 required on this occasion can be such that it is sufficient to supply the spiral spring 18 with a rotational force, the fluctuation of the load can be minimized, thereby realizing a smooth pulling operation of the rope 21.

The rotational force supplied to the spiral spring 18 is then transmitted to the actuating pulley 17 via the cylindrical portion 17*a* to which the inner end of the spiral spring 18 is attached. The rotational force supplied to the actuating pulley 17 is then transmitted via the start-up claws 36, which are engaged with the engaging projections 31, to the interlocking pulley 35 and hence to the crank shaft 2. However, since the load for causing compression of the air-fuel mixture in the internal combustion engine 1 is large, and additionally, since the load is caused to fluctuate during a full rotation of the crank shaft 2, the rotation of the interlocking pulley 35 afforded by the aforementioned rotational force is caused to stop once at the position where the load is large (in the vicinity of the top dead center of the suction stroke).

When the rope handle 22 is pulled again to rotate the rope pulley 20, the spiral spring 18 is further supplied with an additional rotational force, thereby further increasing the torque acting to rotate the actuating pulley 17. Even in this case, due to the presence of the spiral spring 18, the fluctuation of force in pulling the rope handle 22 can be minimized, thereby smoothing the pulling operation. When the magnitude of torque applied to the actuating pulley 17 becomes larger than the load imposed by the internal combustion engine 1, the internal combustion engine 1 is caused to start rotating by application of the torque of the spiral spring 18 to the crank shaft 2. As described above, since the rotation of the internal combustion engine I is started from the state where the piston is stopped in the vicinity of the top dead center of the suction stroke, the engine 1 can be shifted immediately to the combustion/power stroke from the suction stroke, which makes it possible to start the internal combustion engine 1 with preferred timing and high reliability.

When the internal combustion engine 1 has started, the interlocking pulley 35 is caused to rotate by the driving force from the crank shaft 2 side. When the rotational speed of the interlocking pulley 35 exceeds a predetermined value, the start-up claws 36 are caused to pivot radially outwardly, due to the centrifugal force, thereby allowing the start-up claws 36 to be disengaged from the engaging projections 31. As a result, the internal combustion engine 1 is dissociated from the starter 10, thereby enabling the internal combustion engine 1 to continue the stable rotation thereof.

According to this embodiment, on the occasion of starting the internal combustion engine 1, the value of torque of the spiral spring mechanism 15 becomes large at the moment when the load of the internal combustion engine 1 is increased, so that the internal combustion engine 1 can be started with optimum timing and high reliability.

Figure 2:
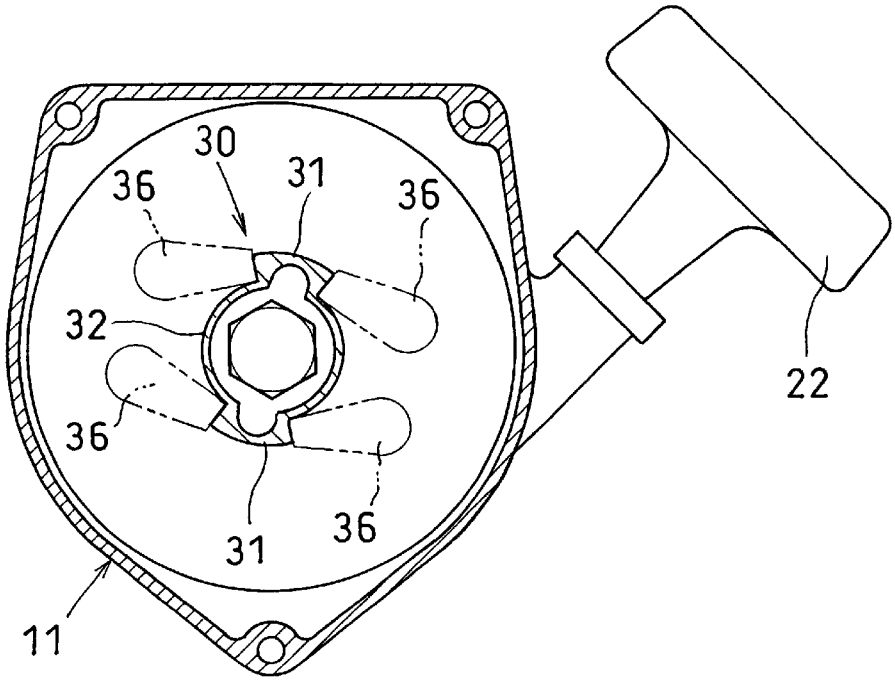
FIG. 2 is a sectional view taken along the line II—II in FIG. 1.
Figure 3:
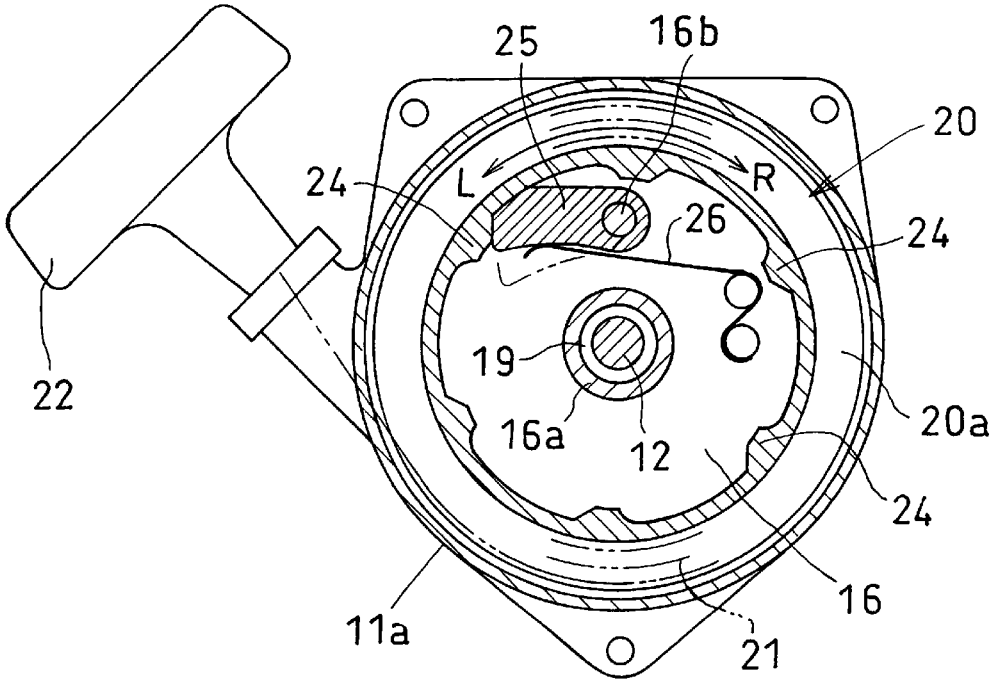
FIG. 3 is a sectional view taken along the line III—III in FIG. 1.

Comparative experiments have been conducted in which the starter according to the above-described embodiment of FIGS. 1 to 3 were compared with the conventional starter (which is arranged such that the rope reel is rotated by pulling a starter rope so as to directly transmit the rotation of the rope pulley to the crank shaft of an engine on the occasion of starting the engine).

In these experiments, three kinds of a small air-cooled internal combustion engine, each differing in displacement (Example 1, Example 2 and Example 3) are employed to investigate the force required for pulling a starter rope, the restartability, the initial startability, the relationship between the number of crankings and the initial rotational speed, and the relationship between the pulling force and the pulling time.

Figure 4:
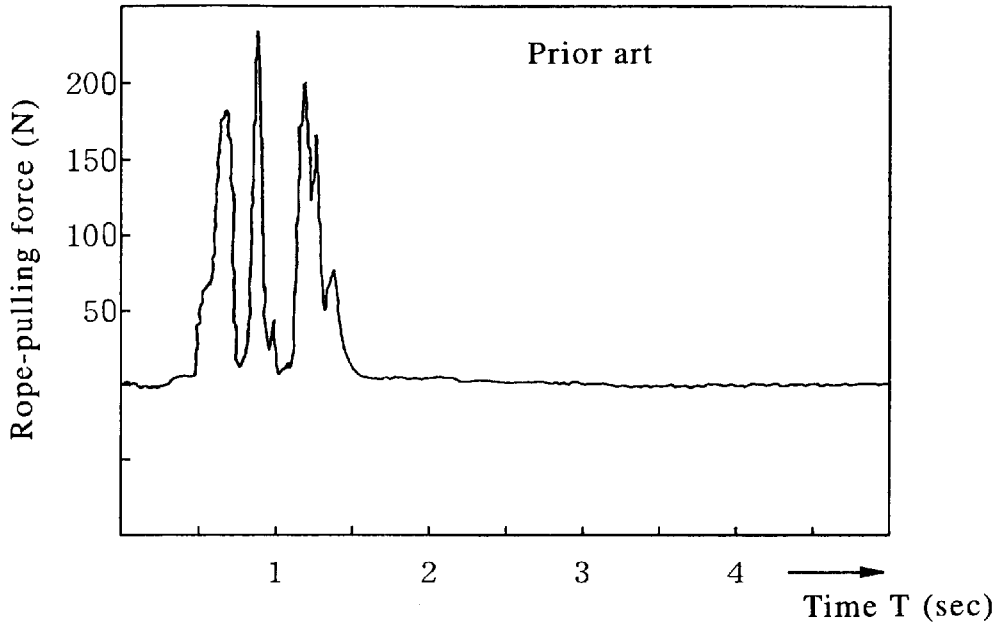
FIGS. 4*a* and 4*b* are graphs illustrating a relationship between the rope-pulling force and the rope-pulling time in a starter according to the prior art and according to the present invention, respectively.
Figure 4:
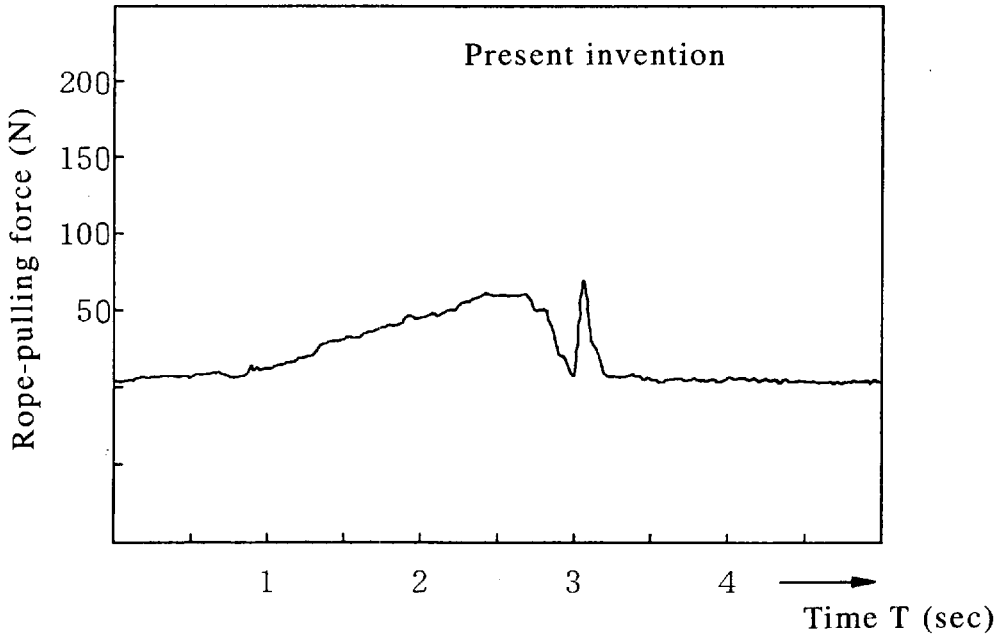

The results of the experiments on the starter according to the embodiment and the conventional starter are shown in Tables 1 to 3 and in FIGS. 4(*a*) and 4(*b*).

TABLE 1

Ex. 1 Displacement 39.7 mL (compression pressure cold 1.41 MPa)

| Recoil-pulling force | | Prior art | Present invention |
|---|---|---|---|
| Non Firing | Max | 166N | 94.3N |
| | Min | 86.7N | 86.3N |
| | $\overline{X}$(n = 10) | 117N | 90.0N |
| Firing | Max | 148N | 101N |
| | Min | 169N | 80.7N |
| | $\overline{X}$(n = 10) | 159N | 91.5N |
| | Restartability (complete explosion) | 10/10 times | 10/10 times |
| Initial startability | 25° C. | 2 times (194, 196N) | 2 times (109, 88.8N) |
| | 5° C. | 9 times (195~102N) | 9 times (122~107N) |
| | 40° C. | 2 times (114, 86.1N) | 1 time (106N) |

| Number of crankings/ Initial rotational speed | Prior art | Present invention |
|---|---|---|
| Ordinary pulling | 7 times/666r/min | 13 times/780r/min |
| Slow pulling | 6 times/600r/min | 8 times/612r/min |
| Quick pulling | 10 times/792r/min | — |

TABLE 2

Ex. 2 Displacement 21.2 mL (compression pressure cold 0.87 MPa)

| | | Prior art | Present invention |
|---|---|---|---|
| Recoil-pulling force (Firing) | Max | 112N | 51.7N |
| | Min | 72.2N | 43.0N |
| | $\overline{X}$(n = 10) | 91.7N | 47.4N |
| | Restartability (complete explosion) | 8/11 times | 10/10 times |
| Initial startability | 29° C. | 3 times (109~102N) | 2 times (62.4, 52.4N) |

| Number of crankings/ Initial rotational speed | Prior art | Present invention |
|---|---|---|
| Ordinary pulling | 6 times/1272r/min | 4 times/1536r/min |
| Slow pulling | 5 times/870r/min | 2 times/923r/min |
| Quick pulling | 7 times/1380r/min | 6 times/1687r/min |

TABLE 3

Ex. 3 Displacement 25.4 mL (compression pressure cold 0.91~0.93 MPa)

| | | Prior art | Present invention |
|---|---|---|---|
| Recoil-pulling force (Firing) | Max | 195N | 64.3N |
| | Min | 69.9N | 60.8N |
| | $\overline{X}$(n = 10) | 98.5N | 62.4N |
| | Restartability (complete explosion) | 7/10 times | 10/10 times |
| Initial startability | 29° C. | 7 times (143~90.4N) | 1 time (60.8N) |

| Number of crankings/ Initial rotational speed | Prior art | Present invention |
|---|---|---|
| Ordinary pulling | 6 times/1302r/min | 7 times/1740r/min |
| Slow pulling | 4 times/936r/min | 5 times/1500r/min |
| Quick pulling | 10 times/1440r/min | 11 times/1980r/min |

As Tables 1 to 3 and FIGS. 4(*a*) and (*b*) show, the starter according to the embodiment was found as requiring a lesser pulling force on the starter rope as compared with that of the conventional starter in all cases of Non-Firing and Firing in all three examples. More specifically, the force pulling the starter rope of the starter according to this embodiment could be reduced as compared with the conventional starter by 30 to 40% on average, or could be reduced to ¼ of the conventional starter in an extreme case. However, with regard to the restartability and initial startability of the engine by the starter according to this embodiment, they are comparable to those of the conventional starter. With respect to the feeling of recoiling, there was no feeling of a jolt; i.e., the recoiling could be performed smoothly.

As compared with the conventional starter, the starter according to this embodiment was found to exhibit generally some increase in the number of crankings of the internal combustion engine relative to a single recoiling by means of the starter rope, irrespective of the pulling speed of the starter rope (normal pulling speed, slow pulling speed and quick pulling speed), but also showed an increase in the initial rotational speed of the internal combustion engine, irrespective of the pulling speed of the starter rope. When the pulling speed of the starter rope of the starter of the embodiment was increased, the initial rotational speed of the internal combustion engine became 1740 r/min with seven crankings, suggesting a great effect by the inertia of the spring-attached pulley disposed in the starter.

In particular, as seen from the graphs shown FIGS. 4(*a*) and 4(*b*), it was found from the comparison between the starter according to the embodiment and the conventional starter that while it is required for the conventional starter in starting the internal combustion engine to pull the starter rope at a high speed and with a strong pull, it is possible in the case of the starter according to the embodiment to reliably start the internal combustion engine by pulling the starter rope at a slow speed and with a weak pull.

It was confirmed from the results of the aforementioned experiments that the starter of the embodiment is advantageous in the following respects over the conventional starter.

With the conventional recoil starter, since the rotational speed of the magneto rotor is required to be increased up to not less than a predetermined value which makes it possible to generate a sufficient electromotive force to ignite the engine, the starter rope is required to be pulled faster than a predetermined speed (a speed required for rotating the crank shaft). However, if the diameter for winding the starter rope is reduced, the strength for pulling the starter rope is required to be increased in order to obtain a predetermined rotational speed, whereas if the diameter for winding the starter rope is enlarged, the speed for pulling the starter rope is required to be increased in order to obtain a predetermined rotational speed, both measures being incompatible with each other. In the case of the starter of the embodiment, even if the speed for pulling the starter rope is slow, it is possible to obtain a rotational speed (a rotational speed which makes it possible to generate a sufficient electromotive force to ignite the engine) which is equal to or higher than the rotational speed of the magneto rotor which can be generated by the ordinary pulling speed of the starter rope of the conventional starter.

Further, with the conventional recoil starter, since the crank shaft (magneto rotor) is arranged to be directly rotated by pulling the starter rope, the startability of the engine is greatly influenced by the pulling speed of the starter rope. Whereas, according to the starter of this embodiment, since the spiral spring mechanism (buffering/power-accumulating device) is interposed between the starter rope and the crank shaft, the force for pulling the starter rope is not directly related to the starting of the engine, but part of the pulling force of the starter rope is accumulated in the spiral spring mechanism in the initial stage of recoiling, and this accumulated pulling force is afterward combined with the actual pulling force of the starter rope in the later stage of recoiling, thereby presenting a resultant force to start the engine. Therefore, even if the force for pulling the starter rope is weak and slow, the engine can be reliably started. The spiral spring mechanism (buffering/power-accumulating device) is capable of not only functioning to buffer and accumulate the pulling force of the starter rope, but also presenting an additional force for starting the engine by releasing the power accumulated therein.

FIGS. 5 to 9 show a power-accumulation type starter according to second embodiment of the present invention. The power accumulation type starter 10' of FIGS. 5 to 9 is disposed close to one end 2*a* of the crankshaft 2 of an internal combustion engine 1, such as a small air-cooled internal combustion engine 1. The power accumulation type starter 10' comprises a case 11 which is adapted to be mounted on one sidewall of the internal combustion engine 1. The case 11 is composed of two members, one of which is a cup-like case member 11*a* to a central bottom portion of which one end 12*a* of a fixing shaft 12 is fastened by means of a nut 13.

The spiral spring mechanism 15 comprises a spiral spring 18, which is interposed between a spiral spring box 16 and an actuating pulley 17. The spiral spring box 16 and the actuating pulley 17 are arranged coaxially with each other and are rotatable relative to each other. Though not shown in detail in these FIGS., the outer end portion of the spiral spring 18 is attached in a well-known manner to the spiral spring box 16, while the inner end portion of the spiral spring 18 is attached also in a well-known manner to the actuating pulley 17, so that when the spiral spring box 16 and the actuating pulley 17 are rotated relative to each other, the rotational force thereof is accumulated in the spiral spring 18.

The spiral spring box 16 of the spiral spring mechanism 15 is provided at the center thereof with a cylindrical portion 16*a*, and a one-way clutch 19 is interposed between the inner peripheral wall of the cylindrical portion 16*a* and the outer peripheral wall of the fixing shaft 12, so that the spiral spring box 16 is supported by the fixing shaft 12 so as to be rotated unidirectionally about the fixing shaft 12. The actuating pulley 17 is provided at the center thereof with a cylindrical portion 17*a* which is rotatably received on the fixing shaft 12, and a retaining bolt 14 is screwed into the fixing shaft 12 from the other end 12*b* of the fixing shaft 12 so as to enable the actuating pulley 17 to be axially fixed and rotatably supported by the fixing shaft 12.

The reel 20 is interposed between the cup-like case member 11*a* and the spiral spring box 16 and is rotatably supported on the outer periphery of the cylindrical portion 16 a of the spiral spring box. 16. The reel. 20 is a rope pulley that can be manually rotated and is provided on the outer periphery thereof with an annular groove 20*a* so as to enable a rope 21 to be wound around it. In the same manner as in the case of the conventional recoiling rope type starter, one end of the rope 21 is fastened to a bottom portion of the groove 20*a*, while the other end of the rope 21 leads out of the cup-like case member 11*a* and is fastened to a rope handle 22. Between the rope reel 20 and the cup-like case member 11*a*, there is interposed a recoil spiral spring 23, the outer end of which is attached to the rope reel 20, and the inner end of which is attached to a central portion of the cup-like case member 11*a*. The rope reel 20 is manually rotated, and then allowed to return to the original portion, thereby enabling the rope 21 to be automatically wound up.

Figure 5:
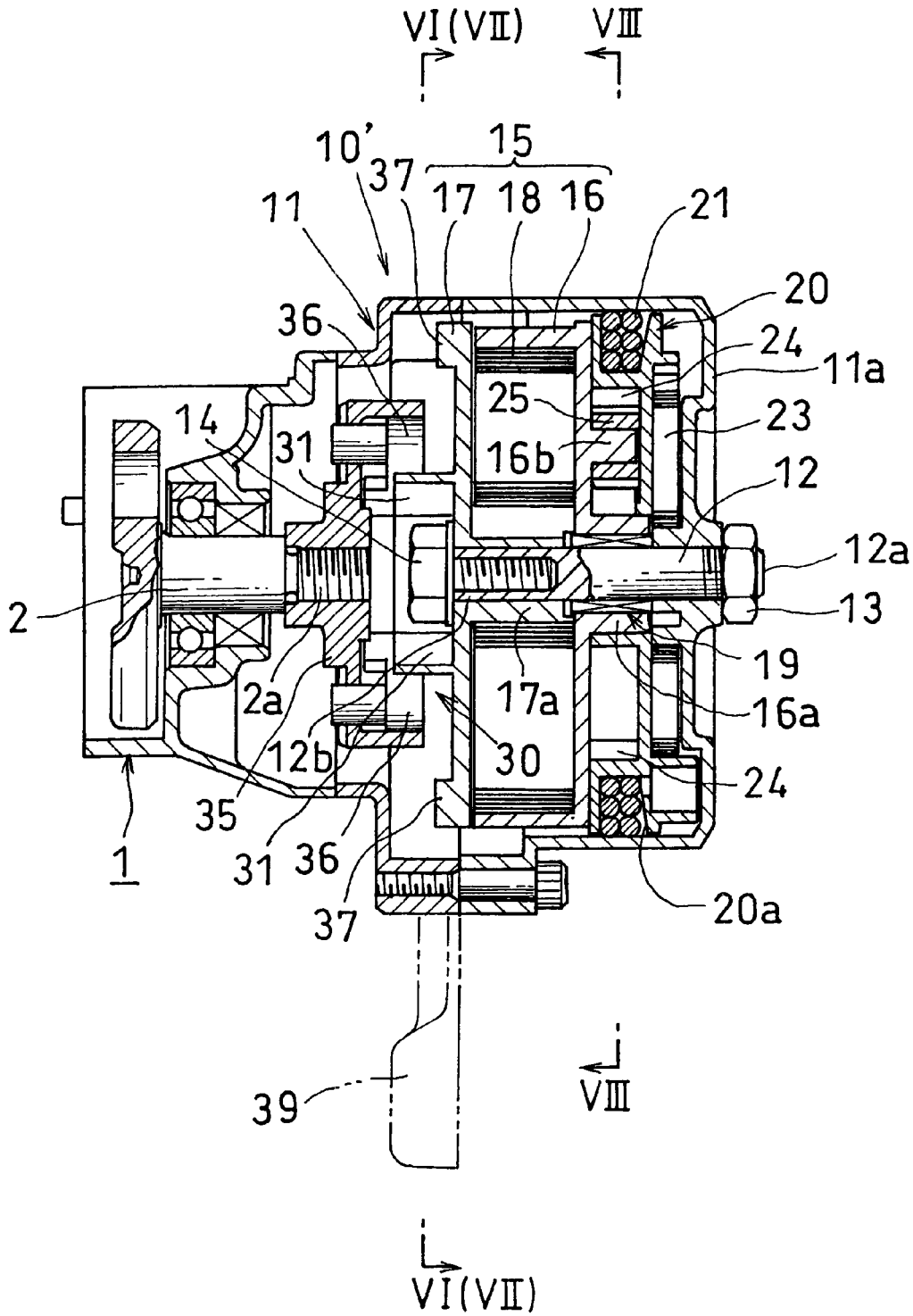
FIG. 5 is a cross-sectional view of a starter representing another embodiment of the present invention.
Figure 6:
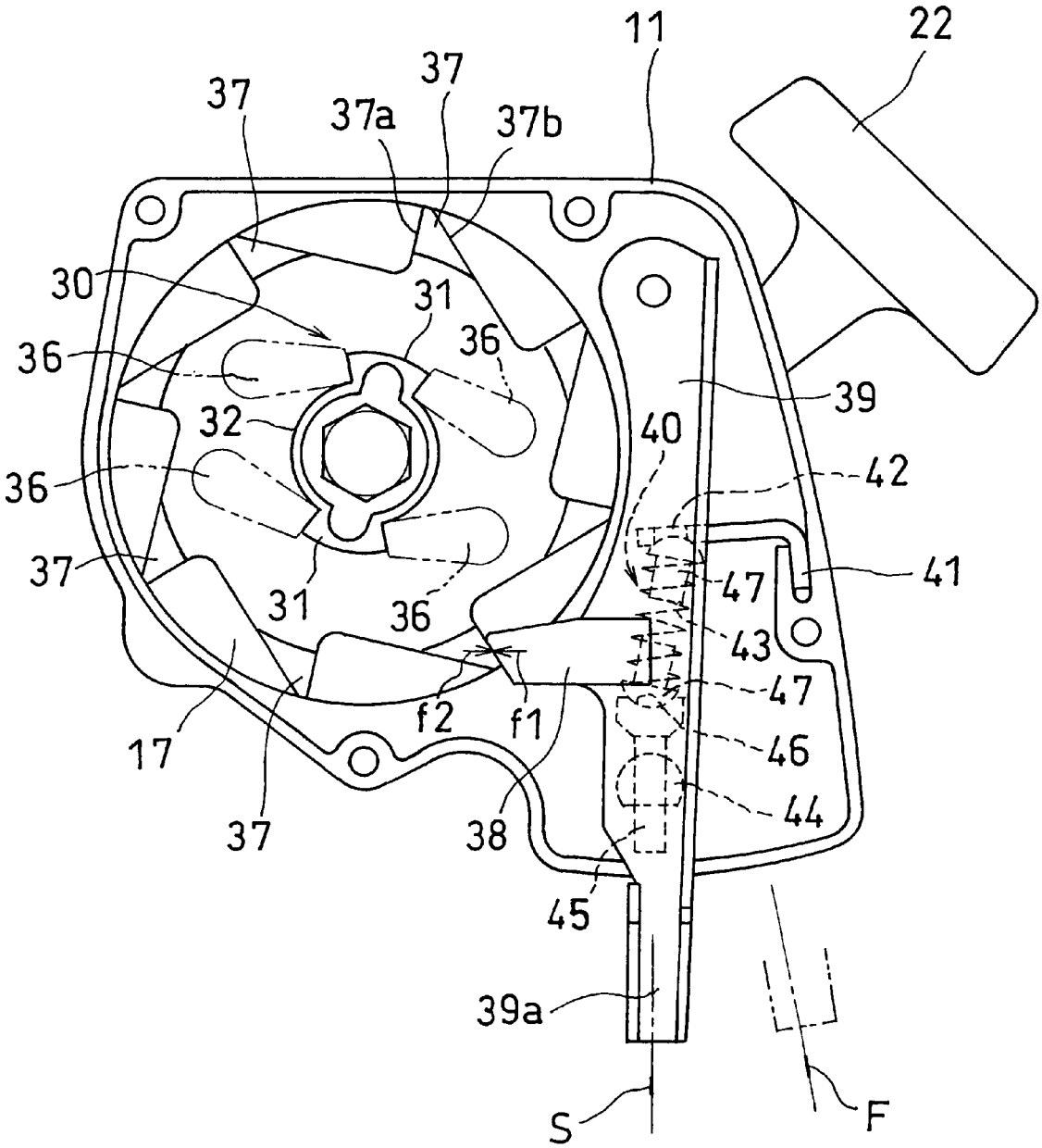
FIG. 6 is a sectional view taken along the line VI—VI in FIG. 5, representing the stop position of the reset lever.
Figure 7:
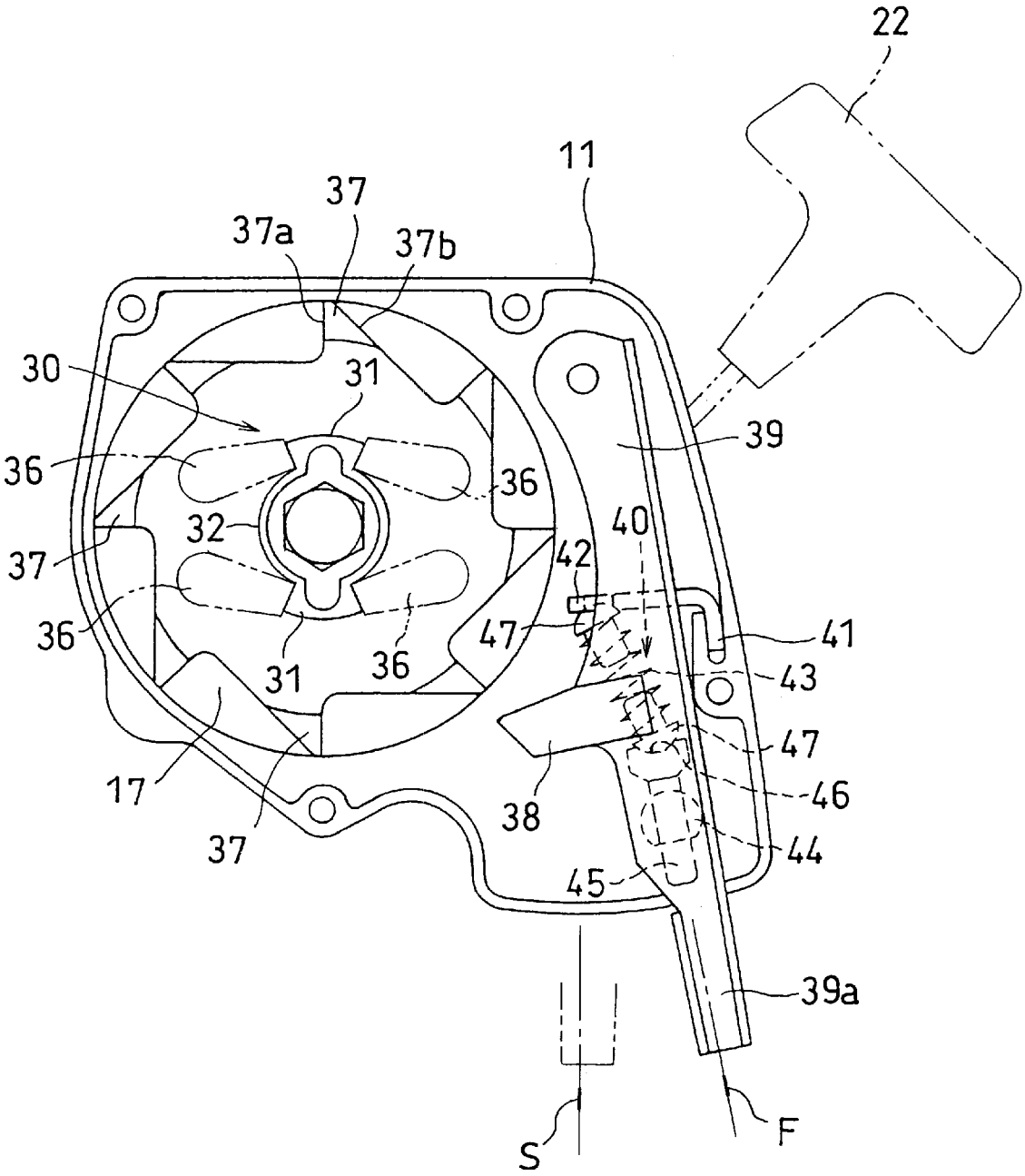
FIG. 7 is a sectional view taken along the line VII—VII in FIG. 5, representing the free position of the reset lever.
Figure 8:
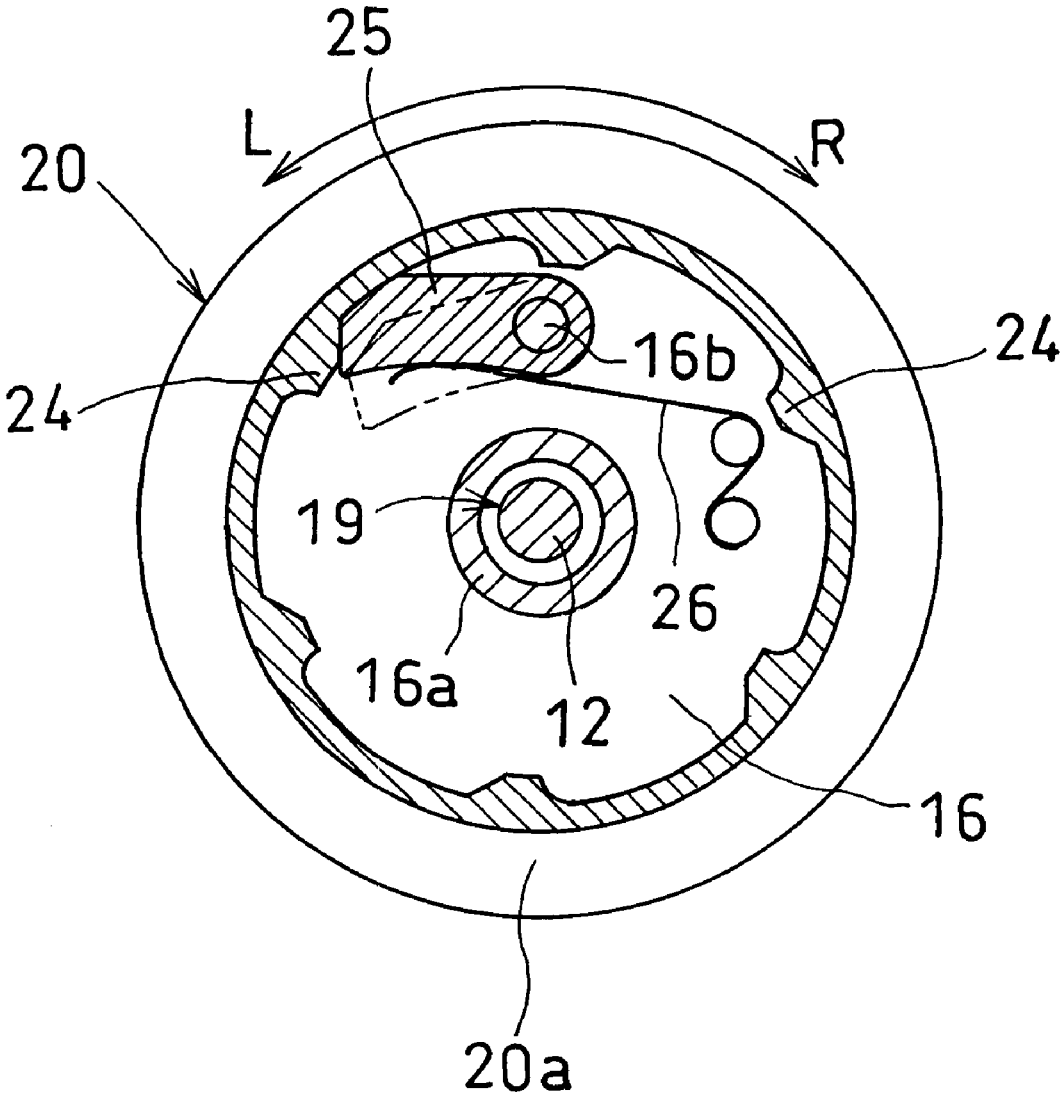
FIG. 8 is a sectional view taken along the line VIII—VIII in FIG. 5, wherein the case and rope are omitted.

Next, the interlocking mechanism between the rope reel 20 and the spiral spring box 16 will be explained with reference to FIGS. 5 and 8. Six engaging protrusions 24 are formed on the inner periphery of the rope pulley 20. A pivot pin 16*b* protruding toward the rope pulley 20 is integrally attached to the side wall of the spiral spring box 16 which faces the rope pulley 20, and an interlocking claw 25 is rotatably supported on the pivot pin 16*b*. The interlocking claw 25 is resiliently engaged with one of the engaging protrusions 24 by means of a pushing spring 26 urged in the radially outward direction. Therefore, when the rope pulley 20 is rotated in one direction R (the clockwise direction in FIG. 8), the spiral spring box 16 is also interlockingly rotated in the same direction R. On the other hand, when the rope pulley 20 is rotated in the opposite direction L (the counter-clockwise direction in FIG. 8), the interlocking claw 25 pivots in the counter-clockwise direction about the pin so as to run idly.

The actuating pulley 17 is provided at the central portion thereof with a pair of engaging projections 31, constituting one of the members of a transmission mechanism 30 disposed to face the crank shaft 2 of the internal combustion engine 1. The pair of engaging projections 31 are joined to each other via an annular wall portion 32. On one side of the internal combustion engine 1 is disposed the interlocking pulley 35 which is fixed to the one end 2*a* of crankshaft 2. Four start-up claws 36 constituting the other member of the transmission mechanism 30 are pivotally supported by the interlocking pulley 35. Each of these start-up claws 36 is ordinarily urged in the radially inward direction by means of a spring (not shown) and hence is engaged with the engaging projections 31. However, when the internal combustion engine 1 is started, the start-up claws 36 are caused to pivot in the radially outward direction by the centrifugal force so as to be disengaged from the engaging projections 31.

As for the number of these start-up claws 36, there is no particular limitation as long as there is at least one start-up claw. The four start-up claws 36 in this embodiment are provided with a view to suitably dispersing the shock generated at the moment of actuating the start-up claws 36 as well as ensuring the actuation of the start-up claws 36.

The actuating pulley 17 is provided on the outer periphery thereof with eight ratchet teeth 37, which are arranged to be engaged with a stopper 38 for keeping the rotational force accumulating in the buffering/power-accumulating device 15 until the torque is increased to a predetermined value. The stopper 38 is attached to a reset lever 39, which is pivotally secured to the case 11. Each of the ratchet teeth 37 is provided with an engaging face 37*a* which is directed toward the center of the actuating pulley 17 and with a slant face 37*b*. The engaging face 37*a* is arranged to be engaged with the stopper 38 so as to prevent the actuating pulley 17 from rotating.

Figure 9:
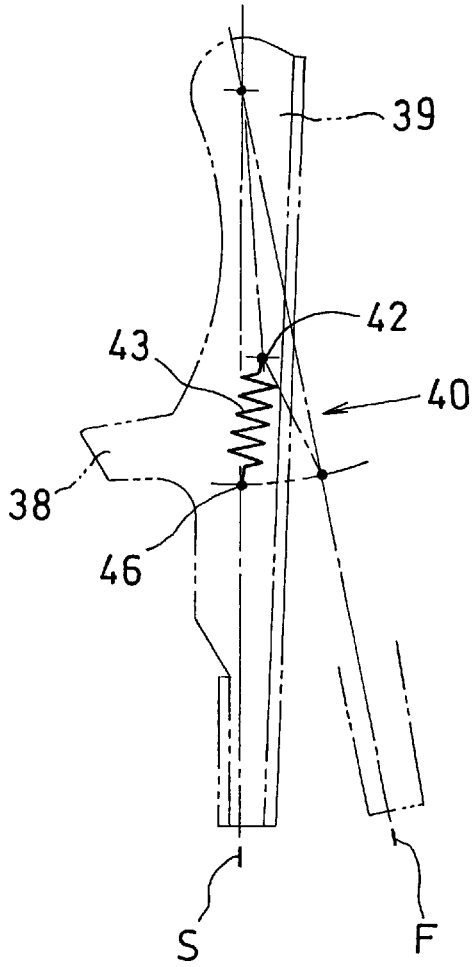
FIGS. 9*a* and 9*b* are schematic views each illustrating the operation of an instantaneous switching mechanism.
Figure 9:
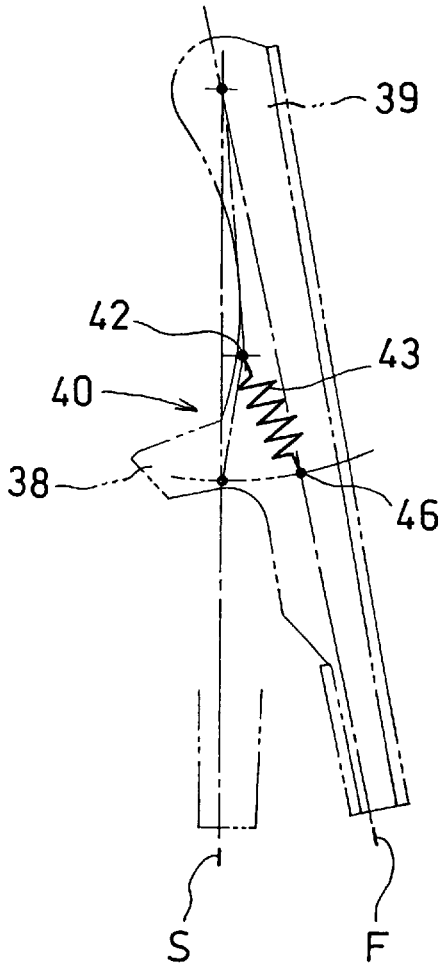

The reset lever 39 is pivotally secured to the case 11 and permitted to move between the stop position S and the free position F by means of an over dead center type instantaneous switching mechanism 40. The instantaneous switching mechanism 40 is constituted by a compression coil spring 43 which is interposed between an anchoring portion 42 of an anchoring member 41 which extends from the cup-like case member 11*a* and the reset lever 39. Specifically, the anchoring member 41 is provided with a chamfered hole or a concave hole functioning as the anchoring portion 42. An adjuster pin 45 is screw-engaged with a shaft member 44 which is fixed to the reset lever 39, and an upper portion of the adjuster pin 45 is constituted by an engaging portion 46 which is formed into a chamfered hole or a concave face. Between the anchoring portion 42 and the engaging portion 46, there is disposed the compression coil spring 43 in a compressed state. A pin 47 having a semi-spherical head is inserted into both ends of the compression coil spring 43. As shown in FIG. 9, the anchoring portion 42 of the anchoring member 41 is positioned such that it is slightly offset toward the stop position S from the center of the pivotable range of the reset lever 39.

Accordingly, when the reset lever 39 is located at the stop position S or the free position F, the compression coil spring 43 is caused to lengthen slightly, whereas when the reset lever 39 is located at the center of the pivotable range of the reset lever 39, the compression coil spring 43 is caused to shorten slightly, thereby permitting the reset lever 39 to pass through the intermediate range and hence to instantaneously move to the stop position S or the free position F. The lower end portion 39*a* of the reset lever 39 protrudes from the case 11, thereby allowing the reset lever 39 to be manipulated by way of the lower end portion 39*a* in switching it to the stop position S or the free position F. The force of the compression coil spring 43 can be adjusted by suitably rotating the adjuster pin 45.

When the reset lever 39 is moved to the stop position S, since the compression coil spring 43 acts on the anchoring portion 42 and the engaging portion 46 of the reset lever 39, the stopper 38 is subjected, as a component force of the compression coil spring 43, to a pushing force f1 (see FIG. 6) in the direction toward the actuating pulley 17. Due to the pushing force f1, the actuating pulley 17 is prevented from being rotated in spite of the accumulated power in the spiral spring 18. Therefore, when the rotational force f2 of the actuating pulley 17 is increased, due to an increasing accumulation of force in the spiral spring 18 by the repetition of pulling the starter rope 21, over the pushing force f1 of the stopper 38, the reset lever 39 is caused to gradually pivot toward the opposite side. Thereafter, when the reset lever 39 is further moved to pass through the aforementioned intermediate range, the reset lever 39 is caused to instantaneously move to the free position F, thereby automatically releasing the stopper 38 and at the same time, allowing the actuating pulley 17 to rotate at a speed which corresponds to the magnitude of accumulation of force in the spiral spring 18.

The reset lever 39 is positioned on the same side of the starter 10' as the rope handle 22 relative to the center of the power accumulation type starter 10' (the right side in FIGS. 6 and 7), so that when an operator carries on his back a small working machine provided with the internal combustion engine 1, the reset lever 39 and the rope handle 22 will both be located on the same side of the machine, thereby enabling the operator to easily manipulate the rope handle 22 and to start the engine 1 with only one hand.

Next, the operation of the power-accumulation type starter 10' constructed according to the second embodiment will be explained. When the internal combustion engine 1 is to be started, the rope handle 22 is manually pulled so as to rotate the rope pulley 20. The rotation of the rope pulley 20 is transmitted to the spiral spring box 16 through the interlocking claw 25 which is resiliently engaged with one of the engaging protrusions 24, thereby allowing the spiral spring box 16 to be rotated synchronously with the rotation of the rope pulley 20. When the pulling force of the rope handle 22 is released, the rope pulley 20 is allowed to reversibly rotate and return to the original position due to the accumulated power (restoring force) of the recoil spiral spring 23. However, the spiral spring box 16 is prevented from rotating reversibly due to the one-way clutch 19, thereby permitting the spiral spring 18 to store a rotational force.

In this case, even if the speed of pulling the rope handle 22 is slow, or even if the pulling distance is short, a rotational force corresponding to such a degree of pulling is stored in the spiral spring mechanism 15, so that if the pulling distance is relatively short, it is simply required to correspondingly increase the number of pulls of the starter rope 21 so as to accumulate the rotational force until a predetermined value of torque is reached. When the rotational force accumulated as a result of the repetition of pulls of the rope handle 22 reaches a predetermined value of torque, the pushing force f2 pushing the stopper 38 by the ratchet tooth 37 of the actuating pulley 17 is increased so as to cause the reset lever 39 to be gradually pivoted in the counter-clockwise direction. As a result, the compression coil spring 43 is compressed.

When the pushing force f2 is further increased, the reset lever 39 is further pivoted, so that as soon as the engaging portion 46 of the reset lever 39 passes through a point on a line extended over the anchoring portion 42, the reset lever 39 is instantaneously switched to the free position F due to the pushing force of the compression coil spring 43, whereby the compression coil spring 43 is caused to lengthen slightly from the compressed state thereof. As explained above, by means of the instantaneous switching mechanism 40, the reset lever 39 is automatically and instantaneously switched to the free position F from the stop position S.

When the reset lever 39 is switched to the free position F, the rotational force accumulated in the spiral spring mechanism 15 is released all at once, thereby causing the interlocking pulley 35 to be rotated by means of the four start-up claws 36, which are engaged with the engaging projections 31. As a result, the crank shaft 2 is rotated with a large torque, thereby making it possible to easily start the internal combustion engine 1. When the internal combustion engine 1 is started, the four start-up claws 36 are caused to pivot in the radially outward direction by the centrifugal force so as to be disengaged from the engaging projections 31, thereby allowing the internal combustion engine 1 to continuously rotate with the actuating pulley 17 being dissociated from the interlocking pulley 35. Since the rotational force which has been retained at a predetermined value of torque can be transmitted all at once to the interlocking pulley 35 from the actuating pulley 17, the internal combustion engine 1 can be easily and reliably started.

When the reset lever 39 is manually switched to the free position F, the reset lever 39 is enabled to be instantaneously switched from the stop position S to the free position F by means of the instantaneous switching mechanism 40. When the rope handle 22 is pulled under this condition, the rotation of the rope pulley 20 is transmitted via the interlocking claw 25 to the spiral spring box 16 to thereby wind up the spiral spring 18, while the spiral spring box 16 is prevented from being reversibly rotated by means of the one-way clutch 19. Although the rotational force by the power accumulated in the spiral spring 18 is presented to the actuating pulley 17 to which the inner end of the spiral spring 18 is attached, since the start-up claws 36 of the interlocking pulley 35 are engaged with the engaging projections 31 of the actuating pulley 17, the interlocking pulley 35 is prevented from rotating at the position where the load is large at the compression stroke of the internal combustion engine 1, thereby rendering the starter 10' in a power-accumulating state.

When the rope handle 22 is further pulled, the rotation of the rope pulley 20 is transmitted likewise via the interlocking claw 25 to the spiral spring box 16 to thereby wind up the spiral spring 18. As a result, the amount of accumulated rotational power in the spiral spring 18 becomes larger gradually, and when the value of torque exceeds the load being imposed by the engine 1, the rotational force of the spiral spring 18 is transmitted, via the engaging projections 31 of the transmission mechanism 30 and the start-up claws 36, to the interlocking pulley 35, thereby enabling the crank shaft 2 to rotate and hence enabling the internal combustion engine 1 to be started.

When the internal combustion engine is started directly by means of the starter rope as in the case of the conventional recoil starter, the load from the internal combustion engine side is rendered to be directly received by the rope handle. As a result, the load is directly transmitted to the operator's hand. Whereas, when the pulling force of the rope handle 22 is transmitted via the spiral spring 18 to the actuating pulley 17 and then, transmitted via the transmitting mechanism 30 to the interlocking pulley 35 as described above, the load from the internal combustion engine side can be alleviated by means of the spiral spring 18. In this case, the spiral spring 18 functions also as a buffering device to the load.

While the foregoing embodiments of the present invention have been explained, it will be understood that the construction of the device can be varied without departing from the spirit and the scope of the invention.

For example, although a spiral spring mechanism is employed as a buffering/power-accumulating device in the above first embodiment, the buffering/power-accumulating device is not confined to such a spiral spring mechanism, but may be any kind of device as long as it is capable of buffering and storing part of the driving side force in a first part of recoiling and at the same time, capable of outputting to the driven side the stored power in the latter part together with the pulling force of the driving side to be supplied in the latter part.

Further, although a spiral spring box securing the outer periphery of the spiral spring is manually rotated so as to rotate the crank shaft by means of an actuating pulley securing the inner periphery of the spiral spring in the above first embodiment, the mechanism may be reversed, i.e., a pulley securing the inner periphery of the spiral spring is manually rotated, and the crank shaft is rotated by means of a spiral spring box securing the outer periphery of the spiral spring.

Further, although a one-way clutch is exemplified as a device for effecting the unidirectional rotation, other means such as a ratchet mechanism may be employed. Although a recoil type rope pulley which can be rotated by pulling a rope is exemplified as a manual reel, it may be constructed to manually rotate a reel by making use of a crank, etc. Further, the transmission mechanism may be constructed to utilize a ratchet mechanism.

In the second embodiment, although a compression coil spring is exemplified as a spring member for the instantaneous switching mechanism, a tension spring may be employed so as to enable the reset lever to instantaneously pass through the intermediate point. Although a recoil type rope pulley is exemplified as a manual reel in the second embodiment, it may be constructed to manually rotate a reel by making use of a crank, etc.

As explained above, it is possible according to the present invention to minimize fluctuations in the pulling force of a starter rope handle so as to make it possible to perform a smooth pulling operation. Therefore, it is now possible, even for a person having weak physical strength, to easily start the engine. Further, since an internal combustion engine can be started always with an optimum timing, the startability of the engine can be improved.

It is possible, according to the power-accumulation type starter of the present invention, to instantaneously release an accumulated power by means of a reset lever, and hence to transmit all at once the rotational force accumulated in the spiral spring accumulation mechanism to the crank shaft, thereby enabling the engine to be reliably started. Additionally, the starter can be simplified in construction, made small in size, and lightened in weight. In a case where the accumulation of power is not necessitated, the starter can be employed in such a manner that the reset lever is shifted to the free position in advance and then the rope handle is pulled, thereby buffering a load from the internal combustion engine side. Furthermore, since a decompressor is not required to be employed in the present invention, the environmental problem associated with use of a decompressor can be avoided.

What is claimed is:

1. A power accumulation-type starter for an internal combustion engine having a crankshaft rotatable about a first axis, comprising:

an interlocking pulley drivably coupled to the crankshaft for rotating the crankshaft in a starting direction about the first axis;

an actuating pulley drivably coupled to the interlocking pulley for rotating the interlocking pulley in the starting direction about a second axis;

a centrifugal clutch operatively interposed between the actuating pulley and the interlocking pulley for disengaging the driving coupling therebetween upon start-up of the internal combustion engine;

a spiral spring box rotatable about the second axis;

a spiral spring encircling the second axis and connected at one end portion to the spiral spring box and at the other end portion to the actuating pulley;

a unidirectional clutch interposed between the spiral spring box and the second axis for permitting rotation of the spiral spring box, and thereby winding of the spiral spring to accumulate energy therein at least sufficient to overcome the rotational resistance exerted by the internal combustion engine on the crank shaft, in one rotational direction about the second axis but preventing rotation of the spiral spring box in the reverse rotational direction about the second axis; and a manually-actuated recoil pulley drivably coupled directly,to the spiral spring box for unidirectionally rotating the spiral spring box in said one rotational direction to cause the spiral spring to be wound about the second axis;

whereby manual actuation of the recoil pulley for one or more times causes energy at least sufficient to overcome the rotational resistance of the internal combustion engine to be stored in the spiral spring.

2. A starter according to claim 1, wherein said one end portion of the spiral spring is the radially outer end portion and said other end portion is the radially inner end portion.

3. A starter according to claim 1, further comprising:

a reset mechanism having a first state of operation, in which the mechanism prevents rotation of the interlocking pulley in the starting direction, and a second state of operation, in which the reset mechanism does not prevent said rotation of the interlocking pulley; and the reset mechanism is selectively switchable from said first state of operation to said second state of operation.

4. A starter according to claim 3, wherein the reset mechanism automatically switches from the first state of operation to the second state of operation in response to the spring force stored in the spiral spring reaching a level at least as high as that required to overcome the rotational resistance of the internal combustion engine.

5. A starter according to claim 4, wherein the level of spring force at which the reset mechanism automatically switches from the first to the second state of operation is in excess of the level required to overcome the rotational resistance of the internal combustion engine.

6. A starter according to claim 3, wherein the reset mechanism comprises a reset lever that is movable between stop and free positions, movement of the lever into the stop position causing the reset mechanism to be placed in the first state of operation and movement of the lever into the free position causing the reset mechanism to be placed in the second state of operation.

7. The starter of claim 6, wherein the reset lever is movable from said stop position to said free position by an instantaneous switching mechanism.

8. A starter according to claim 7, wherein the instantaneous switching mechanism includes a spring member interposed between an anchoring portion and the reset lever.

9. A starter according to claim 6, wherein the reset lever is manually movable from the stop position to the free position.

10. A starter according to claim 1, wherein:

the recoil pulley is coaxially mounted with the spiral spring box for rotation about the second axis; and the recoil pulley includes a rope-winding groove on its outer periphery for receipt of a manually-operated starter rope wound thereon.

* * * * *